US005346588A

United States Patent [19]

Sixta et al.

[11] Patent Number: 5,346,588

[45] Date of Patent: Sep. 13, 1994

[54] PROCESS FOR THE CHLORINE-FREE BLEACHING OF CELLULOSIC MATERIALS WITH OZONE

[75] Inventors: Herbert Sixta, Vöcklabruck; Gerhard Götzinger, Fistersdorf; Anton Höglinger, Timelkam; Peter Hendel, Vöcklabruck; Wilfried Rückl, Vöcklabruck; Walter Peter, Vöcklabruck; Friedrich Kurz, Attnang-Puchheim; Alfred Schrittwieser; Manfred Schneeweisz, both of Vöcklabruck, all of Austria

[73] Assignee: Lenzing Aktiengesellschaft, Lenzing, Austria

[21] Appl. No.: 859,236

[22] Filed: Mar. 26, 1992

Related U.S. Application Data

[63] Continuation of Ser. No. 605,744, Oct. 30, 1990, abandoned.

[30] Foreign Application Priority Data

Oct. 30, 1989 [AT] Austria ..... 2494/89
Nov. 10, 1989 [AT] Austria ..... 2588/89

[51] Int. Cl.[5] ..... D21C 9/153

[52] U.S. Cl. ..... 162/65; 162/78; 162/89

[58] Field of Search ..... 162/65, 78, 88, 29, 162/89

[56] References Cited

U.S. PATENT DOCUMENTS

| | | | |
|---|---|---|---|
| 4,080,249 | 3/1978 | Kempf et al. | 162/65 |
| 4,119,486 | 10/1978 | Eckert | 162/65 |
| 4,216,054 | 8/1980 | Bentvelzen et al. | 162/65 |
| 4,229,252 | 10/1980 | Meredith | 162/65 |
| 4,283,251 | 8/1981 | Singh | 162/65 |
| 4,310,384 | 1/1982 | Meredith et al. | 162/65 |
| 4,372,812 | 2/1983 | Phillips et al. | 162/65 |
| 4,619,733 | 10/1986 | Kooi | 162/65 |
| 4,902,381 | 2/1990 | Meredith | 162/65 |

FOREIGN PATENT DOCUMENTS

| | | |
|---|---|---|
| 380496 | 6/1984 | Austria . |
| 0397308A2 | 11/1990 | European Pat. Off. . |
| 2353674 | 12/1977 | France . |

OTHER PUBLICATIONS

Osawa et al, "The Action of Gaxous Reagents on Cellulosic Materials", *TAPPI*, vol. 46, No. 2 pp. 84–89.

Liebergott et al, "The Use of Ozone in Bleaching and Brightening Wood Pulps", Pulping & Bleaching Seminar, New Orleans (Nov. 1978).

Effect of pulp consistency and pH in ozone bleaching by Carl–Anders Lindholm.

Douglas W. Reeve and Paul F. Earl; "Mixing gases, water, and pulp in bleaching"; Jul. 1986 Tappi Journal; pp. 84–88 (Pulp Mixing).

"Effect of Pulp Consistency and pH Inozone Bleaching" Part 3., Carl–Anders Lindholm, Helsinki Univ. of Technology, Espoo, Finland, pp. 44–50.

"Effect of Pulp Consistency and pH in Ozone Bleaching" Part 4, Carl–Anders Lindholm, Paper & Timber Feb. 1989, pp. 145, 147, 149, 150, 152, 154.

"Effect of Pulp Consistency and pH in Ozone Bleaching" Part 2., Carl–Anders Lindholm, 1987 Int. Oxygen Delignification Conf., pp. 155–165.

*Primary Examiner*—Steve Alvo

*Attorney, Agent, or Firm*—Herbert Dubno; Jonathan Myers

[57] ABSTRACT

A process for the chlorine-free bleaching of pulps in an aqueous suspension which comprises forming the suspension with a consistency of 3 to 20 mass percent; introducing into the suspension an ozone-containing gas having an ozone content of 20 to 300 g/m$^3$ in an amount corresponding to at most 2 mass percent ozone calculated on dry pulp of the suspension during vigorous agitation of the suspension to form a reaction mixture; maintaining a pressure of the ozone-containing gas at a pressure of 1 to 15 bar during introduction into the suspension; and controlling reaction conditions during contact of the ozone-containing gas with the suspension to maintain a reaction temperature of 15° to 80° and a pH value of 1 to 8.

13 Claims, 1 Drawing Sheet

PROCESS FOR THE CHLORINE-FREE BLEACHING OF CELLULOSIC MATERIALS WITH OZONE

This is a continuation of co-pending application Ser. No. 07/605,744 filed on Oct. 30 1990, now abandoned.

FIELD OF THE INVENTION

Our present invention relates to a process for the bleaching of ligno-cellulosic materials, for example, dissolving pulps, for example hardwood (dissolving) pulps with initial kappa values of 15 to 1, usually 4 to 1, or paper pulps, for example softwood pulps with initial kappa values up to 30 and generally up to 10, using ozone.

BACKGROUND OF THE INVENTION

It has already been proposed to utilize ozone as a bleaching agent for ligno-cellulosic materials of the type described in order to enable the bleaching to be effected as much as possible in a chlorine-free manner and thus with greater environmental protection.

Typical of such processes is a process in which the pulp suspension is treated with an ozone-containing gas under vigorous agitation. The term "vigorous agitation" is used herein to include vigorous mixing.

Indeed, chlorine-free and thus ecologically harmless bleaching of pulps, which can be worked up to paper or fibers, utilizing ozone, is described in numerous patents and publications. The various processes described differ primarily in the parameters of the process and the reaction conditions. An important parameter is the consistency, i.e. the percent by weight which is essentially equivalent to the mass percent of the solid pulp in the aqueous suspension.

In principle, these processes can be considered to be in either of two categories, namely, the high consistency (HC) or the low consistency (LC) techniques.

HC ozone bleaching is carried out with consistencies in excess of 25% and generally around 35 to 40%.

Since ozone bleaching normally has not been carried out as the exclusive bleaching operation but is generally provided in combination with other bleaching steps and conventional bleaching can scarcely be carried out at such high consistency ranges, expensive dewatering units must be provided to prepare the pulp suspension for the ozone bleaching. The reaction of ozone with pulp is a two phase reaction which proceeds rapidly to completion.

Aside from the high capital cost of equipment for carrying out HC bleaching for the reason given above, i.e. the cost of the dewatering units, a disadvantage of the HC process is a nonhomogeneous cellulose-damaging ozone attack which appears to be most pronounced at low initial kappa starting values.

(The significance and definition of kappa can be found in col. 2 of U.S. Pat. No. 4,229,252).

In the literature, therefore, it has been suggested that HC ozone bleaching should not be used at kappa values below 10 (Lindholm C. -A. "Effect of pulp consistency and pH in Ozonbleaching" Part 4 Paperi ja Puu—Paper and Timber 2/1989;

Lindholm C. -A. "Effect of pulp consistency and pH in Ozonbleaching" Part 2 1987 Int. Oxygen Delignification Conference, San Diego, Jun. 7–11, 1987, Proceedings, p. 155; Lindholm C. -A. "Effect of pulp consistency and pH in Ozonbleaching" Part 3 Nordic Pulp and Paper Research Journal, No. 1/1988.)

The cellulose damage is still worse when the cellulose is bleached prior to the HC ozone bleaching with oxygen.

The only alternative according to the state of the art is the LC ozone bleaching process if one wishes to avoid the use of chlorine containing environmentally hazardous compounds. The LC ozone bleaching process by comparison to the HC process utilizes more ozone, is more complicated to carry out and requires a greater amount of mixing energy. Furthermore, the reaction volumes are greater and the danger of importing dirt into the process is increased.

It is generally recognized in me art that LC refers to pulps with a consistency of up to 5 or 6%.

In the case of ozone bleaching, however, it is well recognized that only with a consistency of say up to 1% and at most 2% will usable results be obtainable.

For example, U.S. Pat. No. 4,216,054 emphasizes a consistency range of up to 0.7%. Such a consistency range means that the equipment must include a significant investment for a closed water circulation system. This patent describes systematic investigations of LC technology for kraft pulp and concludes that the reaction of ozone with the cellulose is limited by two barriers, namely, the transfer of the ozone from the gas phase to the liquid phase and the transfer from the liquid phase to the solid phase i.e. to the fibers from a minimum mixing power of 11 $kW/m^3$ the second transfer remains rate determinative according to this patent.

An LC bleaching process is also described in U.S. Pat. No. 4,080,249. It is suggested that the agitation energy should amount here preferably to at most 18 kWh/t of the pulp suspension. The bubbles of the ozone containing gas should have a size of at most 3 millimeters. In all of the examples of this patent, consistencies of between 1 and 2% are described, thereby clearly indicating that the document refers to an LC process.

AS part of a broadcast disclosure, apparently to foreclose circumvention of the patent, mention is made of consistencies up to 10% although it is clear in any case that consistencies below 3% are preferred, thereby providing an equally clear indication that consistencies above 3% are not preferred or are detrimental.

Substantially the same can be said for U.S. Pat. No. 4,372,812. Here there is an equally broadcast disclosure of between 1 and 40% although the example only operates in the LC range, namely, with a consistency of 1% (see table 1 of this patent). This document also deals with a multistage bleaching process in which ozone is introduced into one or more stages but not with an ozone bleaching stage per se.

OBJECTS OF THE INVENTION

It is, therefore, the principal object of the present invention to provide an improved method of or process for the bleaching of ligno-cellulosic materials, particularly the materials described above, whereby the aforementioned drawbacks of both HC and LC ozone bleaching processes are avoided and the overall process can be carried out more economically and efficiently while remaining ecologically harmless.

Still another object of the invention is to provide an improved process for the bleaching of pulp which obviates the drawbacks specified of the earlier LC and HC processes.

SUMMARY OF THE INVENTION

We have discovered that the prior art drawbacks can be obviated most surprisingly by providing a middle consistency or middle-consistency range operation which has heretofore not been found to be economical or possible with ozone bleaching by utilizing a pulp suspension having a consistency of 3 to 20 mass percent preferably 5 to 20 mass percent, and even more advantageously 7 to 15 mass percent, by injecting the gas at a superatmospheric pressure of 1 to 15 bar and preferably 1.1 to 10 bar into the pulp suspension.

The process is carried out utilizing ligno-cellulosic materials derived from hardwood (dissolving) pulps with a deciduous wood cellulose with a initial kappa value of 15 to 1, preferably 4 to 1 or with paper pulps or softwood pulps with an initial kappa value up to 30 and preferably up to 10, by bleaching the pulp suspension at a temperature of 15° to 80° C., preferably 40° to 70° C., at a pH value of the suspension and the mixture of 1 to 8, preferably 2 to 3, utilizing the ozone containing gas injected at the superatmospheric pressure with various agitation of the mixture. The ozone containing gas can contain 20 to 300 g/m$^3$ ozone, preferably 50 to 150 g/m$^3$ ozone, and the ozone containing gas is supplied to the suspension in an amount corresponding to at most 2 mass percent based upon the dry pulp content of the suspension treated and preferably 0.05 to 0.5 mass percent of the dry pulp treated. Throughout this description, mass percent can be considered interchangeable with weight percent.

We have found that operating in the middle consistency range described has the advantage over the LC bleaching technique that the reaction vessel can be significantly smaller and the important advantage over the HC technique that in spite of the small volume treated, no expensive dewatering units of the type required by the HC technique are necessary., By injecting the ozone containing gas under pressure simultaneously with vigorous agitation or mixing we are able most surprisingly to obtain excellent bleaching results in the middle-consistency range. More specifically we obtain a homogeneous and uniform efficient reaction of the cellulose with ozone. The mixing energy required is less than in the case of LC bleaching and the reaction of the ozone with the cellulose is carried out more homogeneously than in the HC bleaching technique.

Cellulose damage, measured in terms of viscosity and the DP distribution, even with very low kappa values, is significantly lower than with the HC technique and is at least comparable to that obtainable with the LC technique.

The specific ozone consumption ($O_3$ consumption per eliminated kappa point) is significantly lower than in the case of the LC process.

Existing apparatus can be readily retrofitted or converted to the MC process since apart from the pH-controlled acidification (which is required also for LC and HC processes) it is merely necessary to provide an middle-consistency range pump and an MC mixer. Waste water recycling and reuse of reaction waste gas which may have a residual ozone content is possible so that the system can operate in an ecologically harmless manner taken as a whole, even considering mixing energy, ozone quantities used and the requisite equipment, the process is highly economical.

A further advantage of the invention can be obtained when the bleaching process is used in a multistage bleaching of pulp as the ozone stage. In this system the ozone stage can be utilized together with oxygen bleaching and all operations can be carried out in the middle consistency range with the advantage that a change in the pulp consistency by dewatering or the addition of liquid is not necessary. The overall process is therefore highly economical.

It is known from Austrian Patent 380 496 to carry out an ozone bleaching with pressure. In this process, however, the pulp suspension in the LC range (2.5 to 4.5% consistency) is intensively contacted with an ozone containing gas under pressure (4 bar in the example). Thereafter, the pulp is dewatered to a consistency of 10 to 30% and must be held during the dewatering for at least 20 minutes at the same pressure and the same temperature. According to this patent there is an after reaction which involves an intimate contact of the LC pulp with the ozone containing gas (page 3, lines 41 to 45 of the patent).

By contrast with this disclosure, the present invention has discovered that middle-consistency range pulp can be directly treated with ozone containing gas provided that the gas is under pressure and the process is carried out with simultaneous vigorous agitation. A dilution and dewatering of the pulp suspension as is required by Austrian Patent 380 496 (see page 3, lines 19–20 and 35–36) is unnecessary.

For optimum results in accordance with the present invention it is advantageous to maintain the volume ratio of gas:liquid at 1:0.5 to 1:8 and preferably 1:1 to 1:6.

For compression of the ozone containing gas we preferably use a cooled compressor, most advantageously a water ring pump.

Preferably the vigorous agitation or mixing is carried out using a high-shear mixer.

High-shear mixers are known and have been used for various purposes. For example we may use the high-shear mixer utilized for the dispersion of pigments or dyestuffs in German Patent Document 24 06 430, the high-shear mixer used in the production of PVC powder in U.S. Pat. No. 3,775,359, the high-shear mixer used for the production of semisolid emulsions in U.S. Pat. No. 3,635,834, or the high-shear mixer used in conjunction with pulp suspensions in Japanese Patent 63099389.

A high-shear mixer has plates with protuberances at a given distance from one another and passes the material between these plates to effect an intimate mixing without milling.

It has been found to be advantageous to repeat the ozone bleaching, i.e. to carry out the bleaching process as described in a plurality of successive stages, between which an alkali extraction can be optionally effected. The alkali extraction can be carried out with the use of oxygen or peroxide. This multistage operation can be carried out in a simplified manner in practice by recovering a portion of the pulp downstream of the reactor and recirculating it to the high-shear mixer.

According to another feature of the invention the process is carried out after an oxygen-reinforced and/or a peroxide-reinforced extraction which may optionally be followed by an alkali peroxide bleaching stage.

In addition or alternatively, the ozone bleaching step or steps can be followed by a peroxide bleaching stage and/or an alkali extraction. In peroxide bleaching stages oxygen can also be included.

It has also been found to be advantageous to bring the waste water filtrate resulting at the $O_3$ treatment into contact with at least part of the pulp suspension before the latter is contacted with the ozone containing gas. Together with the waste water filtrate, we may feed to the suspension the acid required to establish the required pH value, preferably sulfuric acid. Since the waste water filtrate is acidic, this method allows a saving in acid. Furthermore, the waste water filtrate can be reused so that it need not be discharged to become a burden to the environment.

If softwood pulp with an initial kappa value of 30 to 10 is used in the process, kappa values below 10 and as low as 5 can be reached by the bleaching operation. If hardwood pulp with initial kappa values of 15 to 1 is used and preferably kappa values of 4 to 1, the product will have kappa values of 12 to 0.5 or 1.5 to 0.5. Initial brightness of 50 to 80%, generally 70 to 80%, can be raised to at least 65 to 90% and usually 75 to 90%.

With the process of the invention it is advantageous to prescribe the molecular weight distribution of the dissolving pulp to obtain best results. For a given pulp, by variation of pH value, the charge of ozone used and the temperature, within the ranges specified, the desired viscosity, DP distribution and reactivity, measured at the filter value can be maintained.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1A:
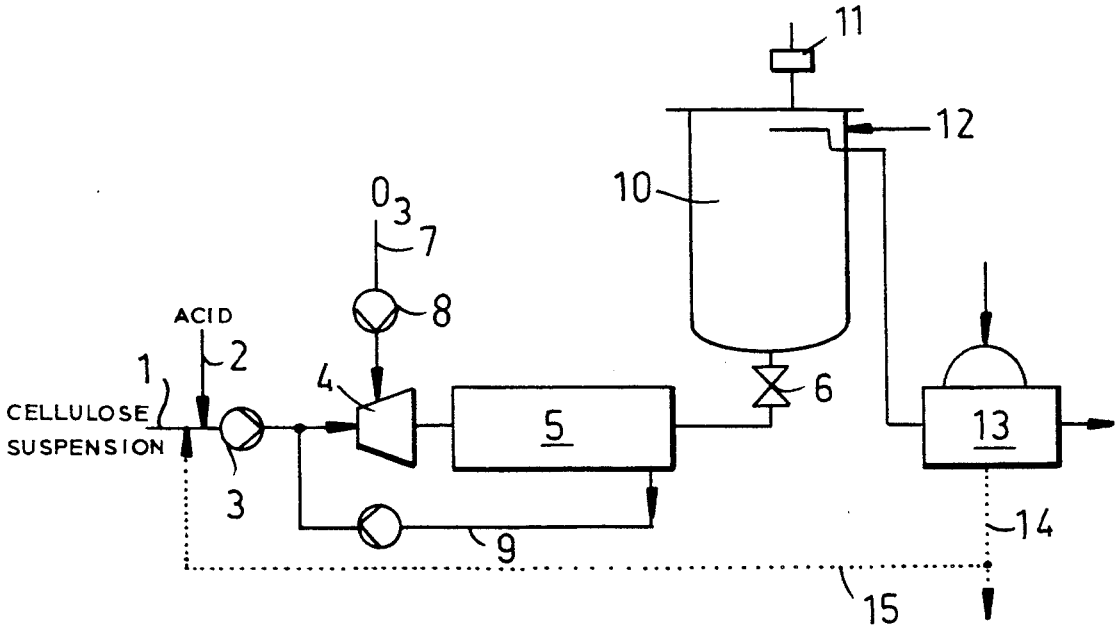
FIG. 1*a* is a flow diagram illustrating one embodiment of the invention.

In the drawing, the pulp suspension is fed at 1 to an MC pump 3 and acid controlled in response to the pH of the suspension is added at 2 to set the pH in the mixer.

The pump 3 pumps the suspension into the middle-consistency range mixer 4 which is a high-shear mixer as described. Ozone containing gas is fed at 7 through the cooled water ring compressor 8 to the mixer 4 where it enters the mixer and maintains it under pressure. In the middle-consistency range mixer 4 an intimate rapid pressurized mixing of the suspension and the ozone containing gas is effected.

Figure 1B:
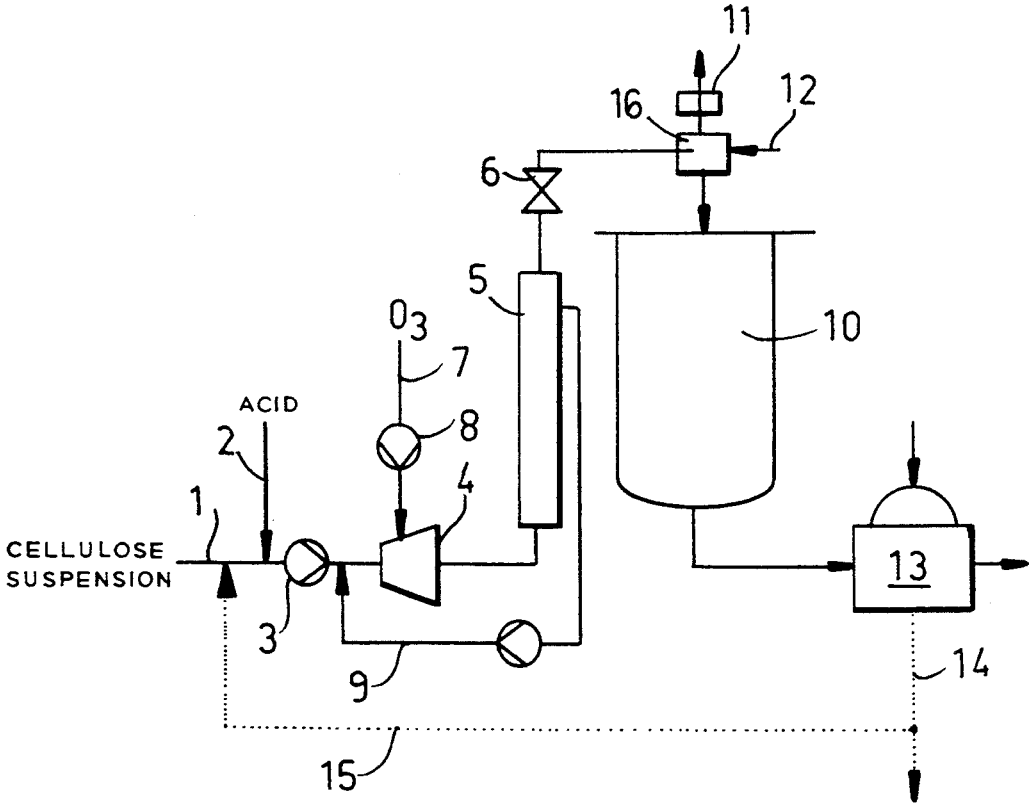
FIG. 1*b* is a flow diagram illustrating another embodiment of the invention.

The reaction continues in a reactor 5 which can be a tube reactor and which is maintained under the pressure of the ozone containing gas. At the end of the reactor 5 a feedback 9 is provided in the form of a pipe and pump to return a portion of the pulp suspension to a location upstream of the mixer so that the pulp suspension is repeatedly subjected to bleaching operation. In both FIGS. 1*a* and 1*b*, the binding of the gas treated solid suspension is carried out in a conventional bleaching tower 10 which has been illustrated although its use is not absolutely necessary. FIG. 1*a* shows the tower to be traversed upwardly and FIG. 1*b* shows an embodiment wherein the tower 10 is traversed downwardly.

In the embodiment having the upwardly following tower (FIG. 1*a*) the gas/solid suspension, with or without a throttle 6 is fed into the tower 10 in which after reaction can occur.

At the top of the tower pressure relief is effected and the waste gas can be vented through a venting unit 11.

The depressurized pulp suspension can then be treated with diluting water at 12 and from the tower 10 deposited upon a washing filter 13.

The waste water filtrate 14 is recycled at 15 to the pulp suspension.

In the use of the downwardly flowing tower (FIG. 1*b*), the pulp suspension from the reaction tube 5 is passed through the throttle 6 to a degassing unit 16 wherein the pressure is relieved to atmospheric pressure. The suspension then passes by gravity through the tower 10 and is transferred to the washing filter 12. Diluting water can be added to the tower if desired.

In both embodiments, the waste gas which may still contain small quantities of ozone may be subjected to treatment by an ozone gas removal process, for example, catalytic or thermal ozone destruction. The oxygen resulting from the waste gas ozone destruction can be fed to an oxygen bleaching stage and the oxygen excess, after appropriate cleaning can be returned to the ozone generator. To the extent that the oxygen is not fed to an oxygen bleaching stage, it can be completely recycled to the ozone generator after any required cleaning steps.

The recycling of waste water and waste gas, especially at relatively high process temperatures can further conserve energy.

The residence time of the pulp suspension in reaction tower 5 or in the bleaching tube 10 should in all cases be under three hours, usually under one hour and preferably less than five minutes.

SPECIFIC EXAMPLES

The following examples relate to the treatment of beech dissolving pulp and spruce paper pulp following a peroxide reinforced oxygen extraction.

EXAMPLE 1

The cellulose has the following characteristics after the peroxide-reinforced oxygen extraction (EOP stage):

| | |
|---|---|
| Kappa unwashed | 2.1 |
| Kappa washed | 1.9 |
| brightness | 76% (Elrepho) |
| viscosity | 255 mP (cuoxam) |
| COD accompanying waste water | 5 g/kg dry pulp |

Ozone bleaching is effected with following parameters:

| | |
|---|---|
| Pressure | 5.2 bar |
| consistency | 10% |
| temperature | 47° C. |
| pH | 2.3 |
| spec. $O_3$-change | 1.82 g $O_3$/kg |
| spec. $O_3$-consumption | 1.69 g/kg |
| Ozone conc. in fresh gas | 76.8 mg/l (STP) |
| Ozone conc. in waste gas | 5.2 mg/l (STP) |
| Reaction Time | 120 s |
| mixing time | 20 s |
| $V_g/V_l$ | 1/3.2 (at 5.2 bar) |
| speed of high-shear mixer | 1700 RPM |

The bleached pulp has the following properties:

| | |
|---|---|
| Kappa | 0.9 |
| delta Kappa | 1.85 |
| $O_3$ consumption/delta Kappa | 0.91 |
| brightness | 83.5% |
| delta brightness | 7.5% |
| viscosity | 214 mP |
| delta viscosity | 41 mP |

EXAMPLE 2

Same pulp as in Example 1 with following exception.

| | |
|---|---|
| Kappa unwashed | 2.9 |
| Ozone bleaching parameters | |
| Pressure | 5.0 bar |
| Consistency | 9.5% |
| Temperature | 50° C. |
| pH | 2.5 |
| spec. $O_3$-change | 1.60 g/kg |
| spec. $O_3$-consumption | 1.60 g/kg |
| Ozone conc. in fresh gas | 79.7 mg/l (STP) |
| Ozone conc. in waste gas | 1.3 mg/l (STP) |
| Reaction Time | 120 s |
| mxing time | 20 s |
| $V_g/V_l$ | 1/2.6 (at 5.0 bar) |
| speed of high-shear mixer | 3,200 RPM |

Bleached pulp properties:

| | |
|---|---|
| Kappa | 1.25 |
| delta Kappa | 1.65 |
| $O_3$ consumption/delta Kappa | 0.95 |
| brightness | 82.5% |
| delta brightness | 6.5% |
| viscosity | 227 mP |
| delta viscosity | 28 mP |

EXAMPLE 3

Pulp parameters:

| | |
|---|---|
| Kappa | 1.9 |
| Viscosity | 255 mP |
| Brightness | 76% |

Ozone bleaching parameters:

| | |
|---|---|
| Pressure | 5 bar |
| Stock density | 10% |
| Temperature | 50° C. |
| pH | 5.0 |
| spec. $O_3$-change | 1.5 g/kg |
| spec. $O_3$-consumption | 1.13 g/kg |
| Ozone conc. in fresh gas | 78. mg/l (STP) |
| Ozone conc. in waste gas | 17. mg/l (STP) |
| Reaction Time | 120 s |
| mixing time | 120 s |
| $V_g/V_l$ | 1/2.6 (at 5 bar) |
| speed of high-shear mixer | 3200 RPM |

Bleached pulp properties:

| | |
|---|---|
| Kappa | 1.1 |
| delta Kappa | 0.95 |
| $O_3$ consumption/delta Kappa | 1.25 |
| brightness | 82.0% |
| delta brightness | 6.0% |
| viscosity | 218 mP |

-continued

| | |
|---|---|
| delta viscosity | 37 mP |

EXAMPLE 4

The pulp of Example 3 was used.

Bleaching parameters:

| | |
|---|---|
| Pressure | 5.0 bar |
| Consistency | 10.7% |
| Temperature | 23° C. |
| pH | 2.5 |
| spec. $O_3$-change | 1.6 g/kg |
| spec. $O_3$-consumption | 1.2 g/kg |
| Ozone conc. in fresh gas | 83.2 mg/l (STP) |
| Ozone conc. in waste gas | 21 mg/l (STP) |
| Reaction Time | 120 s |
| mixing time | 120 s |
| $V_g/V_l$ | 1:2.6 (at 5 bar) |
| speed of high-shear mixer | 3200 RPM |

Bleached pulp properties:

| | |
|---|---|
| Kappa | 0.60 |
| delta Kappa | 1.3 |
| $O_3$ consumption/delta Kappa | 0.91 |
| brightness | 86.3% |
| delta brightness | 10.3% |
| viscosity | 228 mP |
| delta viscosity | 27 mP |

The difference in the solids characteristics between Examples 3 and 4 thus appear to be exclusively a consequence of the different pH values and temperatures. The pH value also can serve to adjust the viscosity.

The following Examples 5 and 6 relate to spruce sulfite pulp. The following test standards for the pulp parameters were used.

| | | |
|---|---|---|
| Breaking length | Austrian Standard ÖNORM L 1114 | results in m |
| WRA = Further tearing strength | German Industrial DIN 53 115 | results in mNm/m |
| Viscosity | Zellcheming | results in mPas · 10 |

EXAMPLE 5

The raw pulp had the following properties:

| | |
|---|---|
| Kappa (Tappi 236 os-76 | 20.4 |
| Viscosity | 1500 mPa s · 10 |
| Brightness (Elrepho) | 49.7% |
| Breaking length (24 oSR) | 8900 m |
| Breaking length (41 oSR) | 9200 m |
| WRA (24 oSR) | 1143 mNm/m |
| WRA (41 oSR) | 1010 mNm/m |
| Bursting (24° SR) | 4.4 kg/cm$^2$ |
| Bursting (41° SR) | 4.2 kg/cm$^2$ |

Bleaching

Bleaching is carried out by the sequence: EOP-$Z_1$-$PE_1$-$Z_2$-$PE_2$ (EOP=peroxide-reinforced alkali oxygen treatment;

Z=ozone treatment; PE=alkali peroxide treatment.)

a) The EOP stage was carried out in an middle-consistency range mixer in accordance with the following parameters:

| | |
|---|---|
| NaOH-supplied | 2.0%/dry solids |
| $H_2O_2$-supplied | 2.0%/dry solids |
| $O_2$-supplied | 2 bar |
| Consistency | 10% |
| Residence Time | 3 h |
| Temperature | 80° C. |

The following pulp properties were obtained:

| | |
|---|---|
| Kappa | 6.6 |
| Brightness | 75.5% |
| Viscosity | 1498 mPas · 10 |
| Breaking length | 7800 m (24 oSR); 8300 m (37 oSR) |
| WRA | 810 mNm/m (24 oSR); 1507 mNm/m 37 oSR) |
| Bursting strength | 3.3 kg/cm$^2$ (24 oSR); 3.5 kg/cm$^2$ (37 oSR) |

With this EOP-prebleached cellulose the remainder of the Sequence $Z_1$-$PE_1$-$Z_2$-$PE_2$ was carried out in three different ways $V_1$, $V_2$, $V_3$.

b) $O_3$ the stage—1 ($Z_1$)

The parameters of the first ozone bleaching and the properties of the pulp thereafter is given as follows:

| Parameter | V1 | V2 | V3 |
|---|---|---|---|
| Consistency (%) | 8.5 | 8.2 | 9 |
| Pressure (bar) | 5.6 | 5.6 | 5.6 |
| Temperature (°C.) | 20 | 31 | 44 |
| pH | 2.5 | 2.5 | 2.5 |
| mixing time (s) | 15 | 15 | 15 |
| Reaction time (s) | 120 | 120 | 120 |
| Speed (RPM) | 3200 | 3200 | 1500 |
| Spec. $O_3$-change (kg/t) | 1.85 | 1.78 | 1.94 |
| Spec. $O_3$-consumption | 1.80 | 1.70 | 1.86 |
| $V_1/V_g$ (at 5.6 bar) | 3.1 | 2.87 | 2.61 |
| Kappa | 4.9 | 4.5 | 4.0 |
| delta Kappa/$O_3$ consumption | 0.94 | 1.2 | 1.40 |
| Brightness (%) | 73.0 | 73.4 | 73.2 |
| Viscosity (mPas · 10) | 1048 | 971 | 976 |

c) $PE_1$-stage

The parameters of the first alkali peroxide treatment and the characteristics of the pulp obtained are given below:

| Parameter | V1 | V2 | V3 |
|---|---|---|---|
| NaOH-supplied (% based upon dry cellulose | 1.0 | 1.0 | 1.0 |
| $H_2O_2$-supplied (% based upon dry cellulose) | 0.7 | 0.7 | 0.7 |
| Consistency (%) | 10 | 10 | 10 |
| Residence time (h) | 2 | 2 | 2 |
| Temperature (°C.) | 65 | 65 | 65 |
| Kappa | 3.2 | 3.2 | 2.7 |
| Brightness (%) | 83.5 | 84.3 | 85.2 |
| Viscosity (mPas · 10) | 1047 | 981 | 972 |

d) Ozone stage—2 ($Z_2$)

Parameters of second ozone bleaching and properties of pulp resulting therefrom:

| Parameter | V1 | V2 | V3 |
|---|---|---|---|
| Consistency (%) | 8 | 8 | 8 |
| Pressure (bar) | 5.6 | 5.6 | 5.6 |
| Temperature (°C.) | 21 | 33 | 45 |
| pH | 2.5 | 2.5 | 2.5 |
| Mixing time (s) | 15 | 15 | 15 |

-continued

| Parameter | V1 | V2 | V3 |
|---|---|---|---|
| Reaction time (s) | 120 | 120 | 120 |
| Mixer-Speed (RPM) | 3200 | 1800 | 3200 |
| Spec. Ozone change (kg/t) | 2.70 | 2.38 | 2.34 |
| Spec. Ozone consumption (kg/t) | 2.06 | 1.85 | 1.92 |
| $V_1/V_g$ (at 5.6 bar) | 2.5 | 2.6 | 2.5 |
| Kappa delta | 1.24 | 1.19 | 1.19 |
| Kappa/Ozone-consumption | 0.95 | 1.08 | 0.79 |
| Brightness (%) | 82.3 | 83.9 | 83.5 |
| Viscosity (mPas · 10) | 679 | 581 | 631 |

e) $PE_2$-stage

Parameters of second alkali peroxide stage and characteristics of resulting pulp:

| Parameter | V1 | V2 | V3 |
|---|---|---|---|
| NaOH-supplied (% based upon dry pulp | 0.7 | 0.7 | 0.7 |
| $H_2O_2$-supplied (% based upon dry pulp | 0.5 | 0.5 | 0.5 |
| Consistency (%) | 10 | 10 | 10 |
| Temperature (°C.) | 65 | 65 | 65 |
| Kappa | 0.6 | 0.6 | 0.6 |
| Brightness (%) | 90.6 | 90.0 | 90.0 |
| Viscosity (mPas · 10) | 650 | 583 | 577 |
| Tear Length | | | |
| (oSR) m | 7600 (20) | 7900 (21) | 7500 (20) |
| (oSR) m | 8000 (34) | 8200 (36) | 8000 (35) |
| WRA | | | |
| (oSR) mNm/m | 1043 (20) | 1080 (21) | 1060 (20) |
| (oSR) mNm/m | 1100 (34) | 1040 (36) | 1047 (35) |
| Bursting strength | | | |
| (oSR)kg/cm$^2$ | 3.13 (20) | 3.30 (21) | 3.27 (20) |
| (oSR)kg/cm$^2$ | 3.50 (34) | 3.37 (36) | 3.43 (35) |

The strength values correspond, in spite of the exceptionally high degree of brightness (greater than 90% and the low viscosity), to those of standard bleached pulp. By standard bleaching we refer to the sequence C-PE-H-H wherein C refers to chlorine bleaching and H to hypochlorite bleaching.

EXAMPLE 6

The same raw material is used as in Example 5, i.e. spruce sulphite pulp and is subjected to the bleaching sequence EOP-Z-PE the conditions V4, V5 of the final bleaching stage PE were varied with the goal of obtaining a degree of brightness greater than 85% with the highest possible strength values.

a) The EOP bleaching was effected as in Example 5.

b) Ozone bleaching (Z)

The parameters of the ozone bleaching and the characteristics of the pulp after ozone bleaching were the following:

| Parameter | |
|---|---|
| Consistency (%) | 12 |
| Pressure (bar) | 6.2 |
| Temperature (°C.) | 24 |
| pH-Value | 2.5 |
| Mixing time (s) | 15 |
| Reaction time (s) | 120 |
| MC-Mixer-Speed (RPM) | 1700 |
| spec. Ozone change (kg/t) | 2.62 |
| spec. Ozone consumption (kg/t) | 2.37 |
| $V_1/V_g$ | 2.56 |
| Kappa | 3.7 |
| delta Kappa/ozone-consumption | 1.22 |

-continued

| Parameter | |
|---|---|
| Viscosity (mPas · 10) | 771 |
| Brightness (%) | 75.7 |

c) PE-stage

The parameters of the alkali peroxide treatment and the properties of the pulp are:

| Parameter | V4 | V5 |
|---|---|---|
| NaOH-supplied (% based upon dry pulp | 2.5 | 2.5 |
| $H_2O_2$-supplied (% based upon dry pulp | 1.0 | 1.5 |
| Consistency (%) | 10 | 10 |
| Residence Time | 3 | 3 |
| Temperature (°C.) | 65 | 65 |
| Mg-Salt (%) | 0.2 | 0.2 |
| Kappa | 86.2 | 87.1 |
| Brightness (%) | 86.2 | 87.1 |
| Viscosity (mPas · 10) | 904 | 713 |
| Breaking Length (oSR) m | 7900 (23 | 7800 (21) |
| m | 8200 (23) | 8100 (35) |
| WRA (oSR) mNm/m | 1020 (23) | 1030 (21) |
| Bursting Strength (oSR) kg/cm$^2$ | 3.40 (23) | 3.3 (21) |

The strength values of the pulp resulting from this three-stage bleaching corresponded substantially to those of the five-stage bleached pulp. With sequential use of lesser specific ozone quantities, the strength characteristics of the pulp are not effected but a much higher degree of brightness can be obtained.

We claim:

1. A process for the chlorine free bleaching of pulps in an aqueous suspension which comprises:

(a) forming said suspension with a consistency of 3 to 20 mass percent;

(b) introducing into said suspension an ozone-containing gas having an ozone content of 20 to 300 g/m$^3$ in an amount corresponding to at most 2 mass percent ozone calculated on dry pulps of said suspension during vigorous agitation in a high shear mixer of the suspension to react with the suspension forming a reaction mixture;

(c) maintaining a pressure of said ozone-containing gas at a pressure of 1.1 to 15 bar during introduction into the suspension;

(d) transferring the suspension of the ozone-containing gas from the high shear mixer to a tube reactor and continuing the reaction of the suspension and the ozone-containing gas, while maintaining the pressure of the ozone-containing gas at 1.1 to 15 bar; and (e) controlling reaction conditions during contact of the ozone-containing gas with the suspension during steps (b), (c) and (d) to maintain a reaction temperature of 15° to 80° C., a pH of 1 to 8, and a volume ratio of gas:liquid in said reaction mixture of 1:2.5 to 1:6.

2. The process for the chlorine-free bleaching of pulps defined in claim 1 wherein according to step (d) the reaction mixture has a residence time in the reactor of about 2 minutes.

3. The process defined in claim 1 wherein:

said pulps in said suspension are hardwood pulps with an initial kappa value of 15 to 1 or paper pulp or softwood pulps with an initial kappa value up to 30;

said temperature is 40° to 70° C.;

said pH is substantially 2 to 3;

said ozone-containing gas introduced into said suspension contains 50 to 150 g/m$^3$ ozone;

said ozone-containing gas is introduced into said suspension in an amount corresponding to 0.05 to 0.5 mass percent ozone calculated on dry pulp of said suspension;

said suspension has a consistency of 5 to 20 mass percent; and said ozone-containing gas is introduced into said suspension at a pressure of 1.1 to 10 bar.

4. The process defined in claim 3 wherein:

said suspension has a stock density of 1 to 15 mass percent.

5. The process defined in claim 3 wherein said ozone-containing gas is compressed in a cooled compressor before introduction into said suspension.

6. The process defined in claim 5 wherein said ozone-containing gas is compressed in a water-ring pump forming said cooled compressor before introduction into said suspension.

7. The process defined in claim 3 wherein the bleaching is repeated in a subsequent bleaching stage following a prior bleaching stage.

8. The process defined in claim 7, further comprising the step of effecting an alkali extraction on said mixture between said bleaching stages.

9. The process defined in claim 3 wherein the ozone bleaching is carried out after an oxygen-reinforced or peroxide-reinforced extraction of the suspension.

10. The process defined in claim 3 wherein the ozone bleaching is carried out after an oxygen-reinforced or peroxide-reinforced extraction of the suspension followed by an alkaline peroxide treatment step.

11. The process defined in claim 5 wherein the ozone bleaching is followed by a peroxide stage or an alkali extraction.

12. The process defined in claim 3 wherein at least part of the suspension is treated prior to contact with said ozone-containing gas with a waste-water filtrate from ozone-treated waste water and, together therewith, with acid for adjusting the pH of said suspension.

13. The process defined in claim 12 wherein said acid is sulfuric acid.

* * * * *